US006428380B1

(12) United States Patent
Murphy

(10) Patent No.: US 6,428,380 B1
(45) Date of Patent: Aug. 6, 2002

(54) METHOD AND APPARATUS FOR APPLYING A TRANSPARENT SKIN TO A MODEL AIRPLANE

(76) Inventor: Michael B. Murphy, 149A Burmont Rd., Drexel Hill, PA (US) 19026

( * ) Notice: Subject to any disclaimer, the term of this patent is extended or adjusted under 35 U.S.C. 154(b) by 0 days.

(21) Appl. No.: 09/503,454

(22) Filed: Feb. 14, 2000

Related U.S. Application Data

(63) Continuation-in-part of application No. 09/016,956, filed on Feb. 2, 1998, now abandoned.

(51) Int. Cl.[7] ..... A63H 27/00

(52) U.S. Cl. ..... 446/34; 446/57; 446/59; 446/60; 428/34.9; 156/215; 156/217

(58) Field of Search ..... 446/34, 57, 59, 446/60

(56) References Cited

U.S. PATENT DOCUMENTS

| | | | | | |
|---|---|---|---|---|---|
| RE17,564 | E | * | 1/1930 | Schutte | 446/57 |
| 2,195,695 | A | * | 4/1940 | Daniel | 446/34 |
| 2,356,927 | A | * | 8/1944 | Grossman | 244/133 |
| 2,414,125 | A | * | 1/1947 | Rheinfrank | 114/358 |
| 2,417,586 | A | * | 3/1947 | Crosley | 114/357 |
| 3,140,846 | A | * | 7/1964 | Lott | 156/215 |
| 3,956,529 | A | * | 5/1976 | Addison | 244/126 |
| 4,406,446 | A | * | 9/1983 | Lind | 269/152 |
| 4,470,862 | A | * | 9/1984 | More et al. | 156/217 |
| 4,997,688 | A | * | 3/1991 | Hardman | 156/307.5 |

OTHER PUBLICATIONS

Covering Model Aircraft, Ian Peacock, Argus Books, 1989, pp 16/17.*
www.fortunecity.com/meltingpot/palau/4/id167.htm.*
www.wwcn.org/~grit/faqs/airmodelsfaq.html.*
www.krc.org/planes/slowmo.htm.*
www.ezonemag.com/articles/1999/oct/elipstik/elipstik.shtml.*

* cited by examiner

*Primary Examiner*—Derris H. Banks
*Assistant Examiner*—Dmitry Suhol

(57) ABSTRACT

A model airplane includes a main body component, a wing component, a horizontal stabilizer component, and a vertical stabilizer component. At least some of the components are fabricated of a shell of lightweight wood with spaces therebetween. A sheet of lightweight plastic material covers each of the components. The material is wrapped around the components with an individual sheet for the components. The plastic material is lightweight with a thickness of between about 0.65 and 0.85 mils and has the ability when heated to contract to about 25 percent of its original size.

1 Claim, 5 Drawing Sheets

METHOD AND APPARATUS FOR APPLYING A TRANSPARENT SKIN TO A MODEL AIRPLANE

RELATED APPLICATION

This is a continuation in part of application Ser. No. 09/016,956 filed Feb. 2 1998 now abandoned.

BACKGROUND OF THE INVENTION

1. Field of the Invention

The present invention relates to a method and apparatus for applying a transparent skin to a model airplane and more particularly pertains to showcasing an interior structure of a model airplane and to increase structural integrity of rubber band powered balsa wood framework models, previously tissue paper and dope.

2. Description of the Prior Art

The use of model airplane kits is known in the prior art. More specifically, model airplane kits heretofore devised and utilized for the purpose of building model airplanes are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. Nos. 4,763,783; 4,024,002; 5,387,470; 4,225,049; 3,956,529; and U.S. Pat. No. Des. 243,969.

In this respect, the method and apparatus for applying a transparent skin to a model airplane according to the present invention substantially departs from the conventional concepts and designs of the prior art, and in so doing provides an apparatus primarily developed for the purpose of showcasing an interior structure of a model airplane and increase integrity.

Therefore, it can be appreciated that there exists a continuing need for a new and improved method and apparatus for applying a transparent skin to a model airplane which can be used for showcasing an interior structure of a model airplane. In this regard, the present invention substantially fulfills this need.

SUMMARY OF THE INVENTION

In view of the foregoing disadvantages inherent in the known types of model airplane kits now present in the prior art, the present invention provides an improved method and apparatus for applying a transparent skin to a model airplane. As such, the general purpose of the present invention, which will be described subsequently in greater detail, is to provide a new and improved method and apparatus for applying a transparent skin to a model airplane which has all the advantages of the prior art and none of the disadvantages.

To attain this, the present invention is adapted for use with a a model airplane having a plurality of components including a fuselage and at least a pair of wings to form a monoplane or two pair of wings to form a biplane. A plurality of rectangular plastic sheets are adapted to shrink and conform to a recipient surface upon the heating thereof. Adhesive tape is provided for adhering edges of the plastic sheets to the model airplane. A hair dryer is utilized for shrinking plastic sheets such that the sheets conform to the components of the model airplane.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved method and apparatus for applying a transparent skin to a model airplane which has all the advantages of the prior art model airplane kits and none of the disadvantages.

It is another object of the present invention to provide a new and improved method and apparatus for applying a transparent skin to a model airplane which may be easily and efficiently manufactured and marketed.

It is a further object of the present invention to provide a new and improved method and apparatus for applying a transparent skin to a model airplane which is of a durable and reliable construction.

An even further object of the present invention is to provide a new and improved method and apparatus for applying a transparent skin to a model airplane which is susceptible of a low cost of manufacture with regard to both materials and labor, and which accordingly is then susceptible of low prices of sale to the consuming public, thereby making such method and apparatus for applying a transparent skin to a model airplane economically available to the buying public.

Still yet another object of the present invention is to provide a new and improved method and apparatus for applying a transparent skin to a model airplane which provides in the apparatuses and methods of the prior art some of the advantages thereof, while simultaneously overcoming some of the disadvantages normally associated therewith.

Still another object of the present invention is to showcase an interior structure of a model airplane.

Lastly, it is an object of the present invention to provide a model airplane including a main body component, a wing component, a horizontal stabilizer component, and a vertical stabilizer component. At least some of the components are fabricated of a shell of lightweight wood with spaces therebetween. A sheet of lightweight plastic material covers each of the components. The material is wrapped around the components with an individual sheet for the components. The plastic material is lightweight with a thickness of between about 0.65 and 0.85 mils, preferably about 0.75 mils, and has the ability when heated to contract about 25 percent of its original size.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
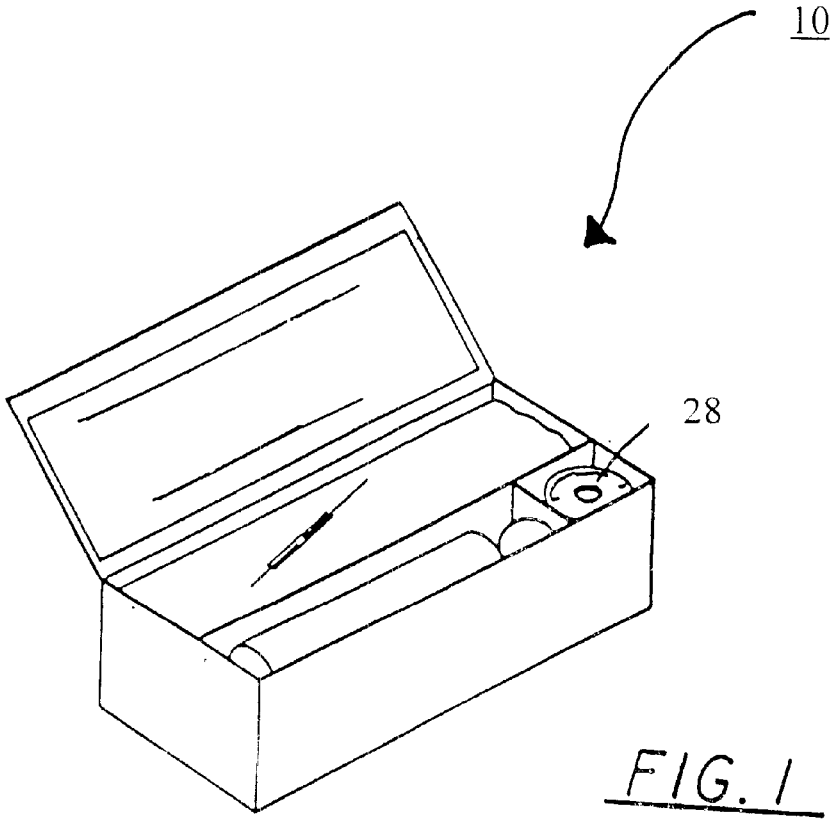
FIG. 1 is a perspective illustration of the preferred embodiment of the method and apparatus for applying a transparent skin to a model airplane constructed in accordance with the principles of the present invention.
Figure 2:
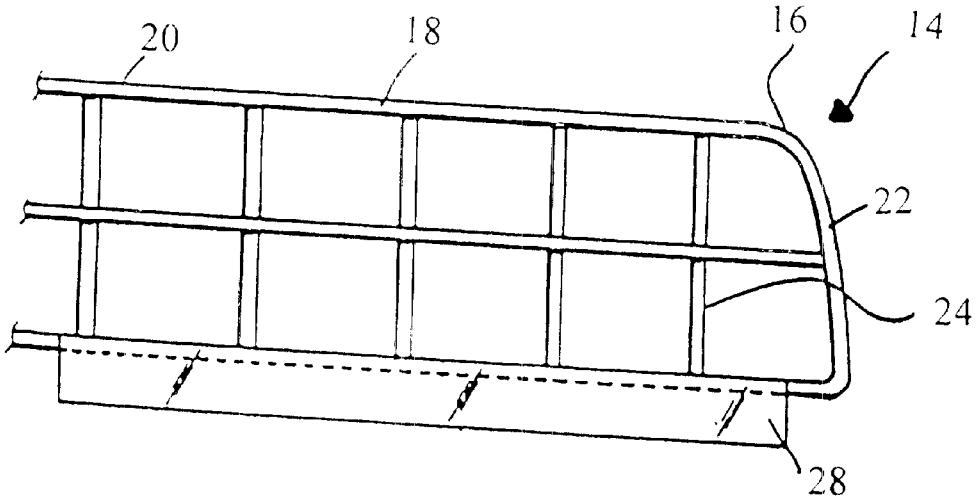
FIG. 2 is top view of the tape applied to the model airplane.
Figure 3:
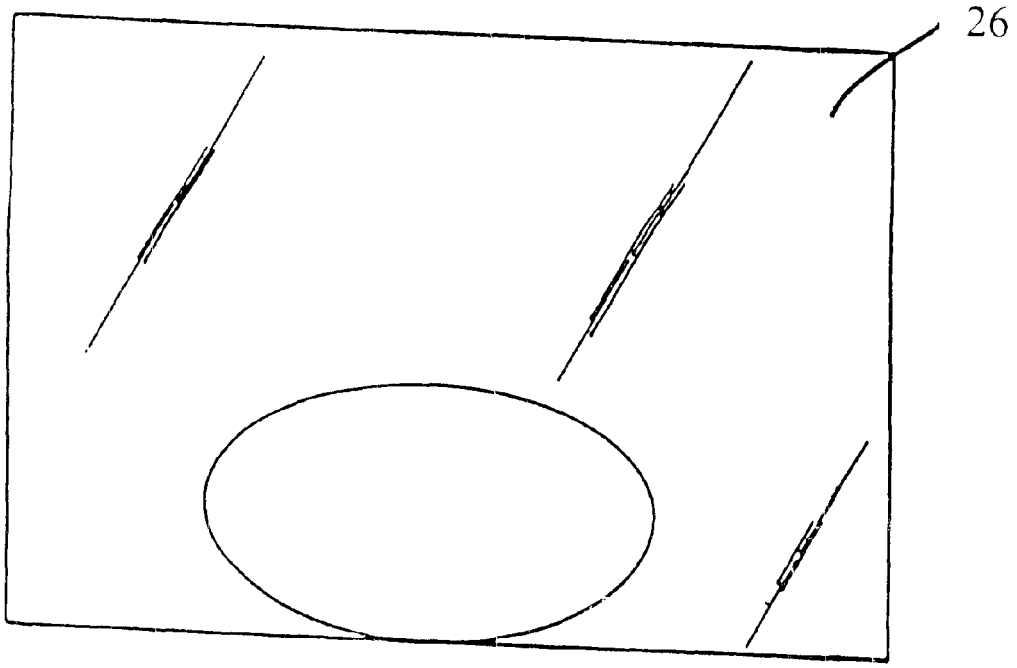
FIG. 3 is a view of one of the plastic sheets of the present invention.

With reference now to the drawings, and in particular to FIG. 1 thereof, a new and improved method and apparatus for applying a transparent skin to a model airplane embodying the principles and concepts of the present invention and generally designated by the reference numeral 10 will be described.

The present invention, the new and improved method and apparatus for applying a transparent skin to a model airplane, is comprised of a plurality of components. Such components are individually configured and correlated with respect to each other so as to attain the desired objective.

More specifically, it will be noted that the system 10 of the present invention is adapted to be used with a wooden model airplane 14 having a plurality of components. Such components include a fuselage and at least a pair of wings 16. The wings are each constructed from an outer periphery 18 defined by a pair of spaced linear members 20 situated in parallel. An end connector 22 is coupled between ends of the linear members and in perpendicular relationship therewith. A plurality of lateral supports 24 are connected between the spaced linear members in perpendicular relationship therewith. Each lateral support has a pair of side faces with an air foil configuration for defining a peripheral edge with a similar air foil configuration.

The present invention includes a plurality of rectangular transparent plastic sheets 26 functioning to shrink and conform to a recipient surface upon the heating thereof. Also included is a roll of tape 28 having an adhesive lining both sides thereof for adhering the plastic sheets to the model airplane.

Figure 5:
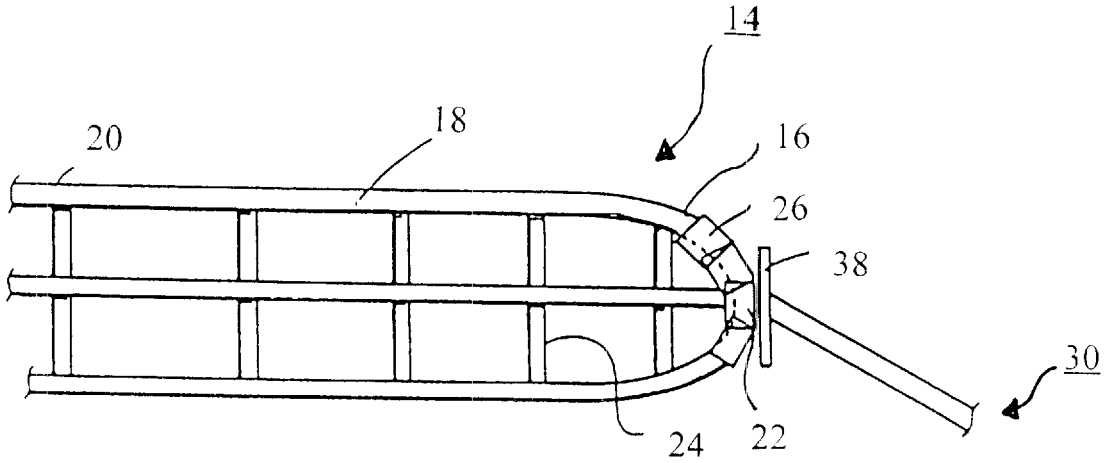
FIG. 5 is a view of the application of a piece of one of the plastic sheets on the model airplane.
Figure 6:
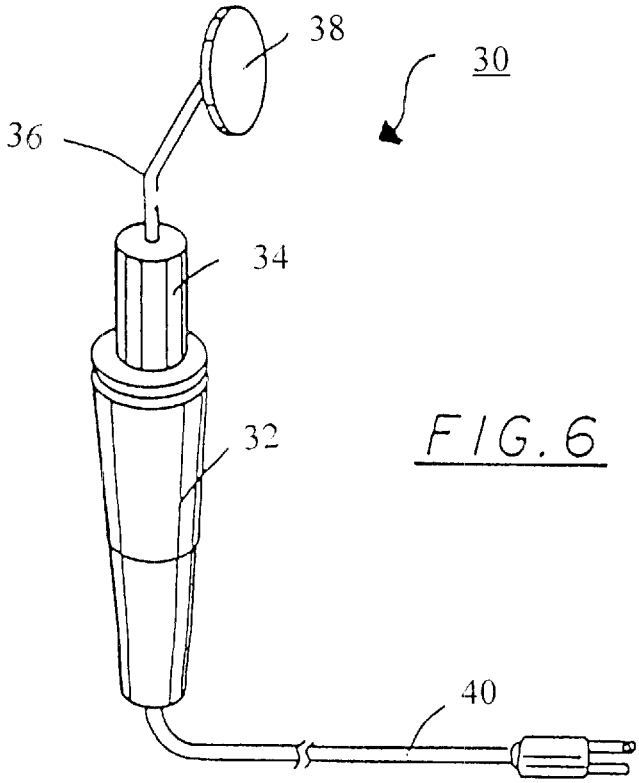
FIG. 6 is a perspective view of the heater to be used with the present invention.
Figure 7:
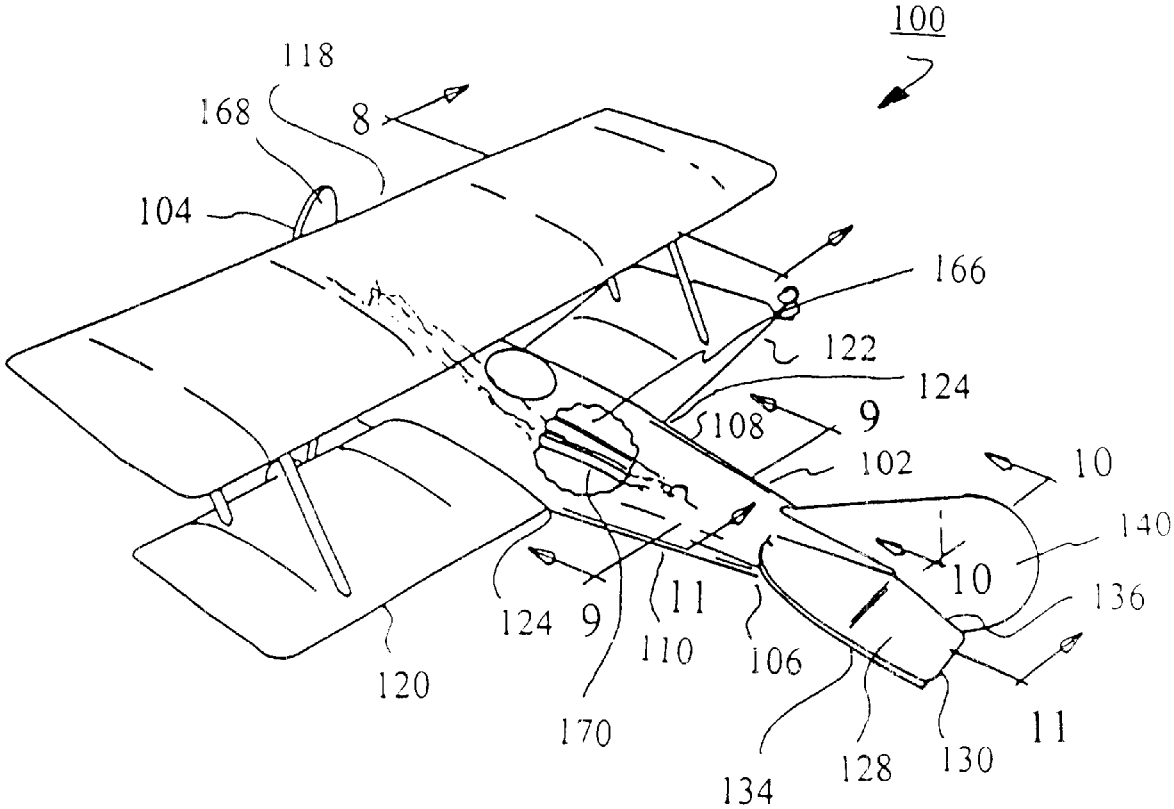
FIG. 7 is a perspective illustration of an alternate embodiment of the invention.
Figure 8:
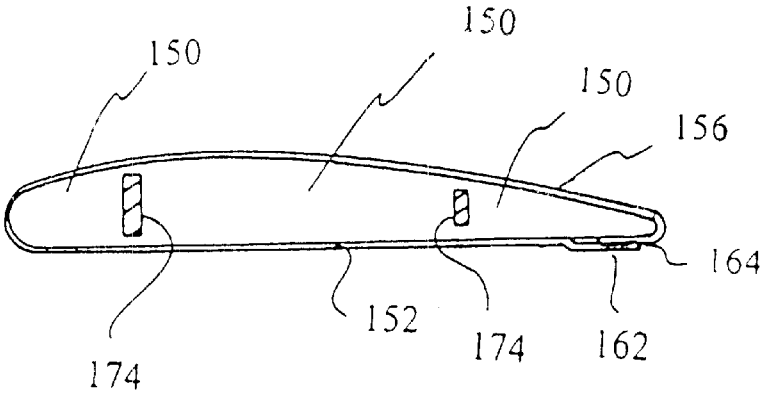
FIGS. 8, 9, 10 and 11 are cross-sectional views taken along line 8—8, 9—9, 10—10 and 11—11 of FIG. 7.
Figure 9:
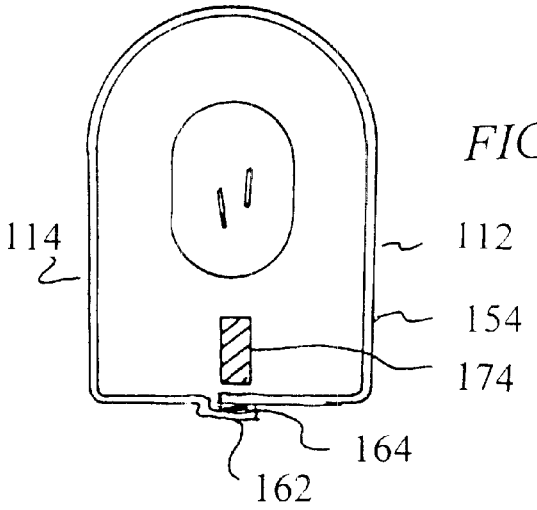
Figure 10:
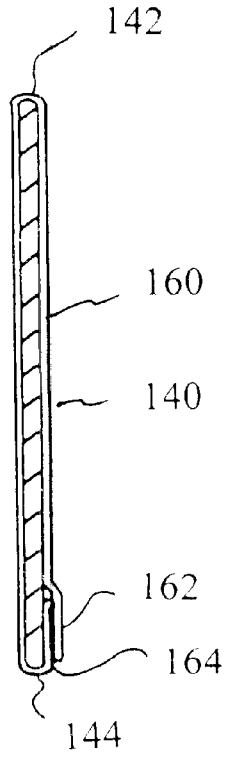
Figure 11:
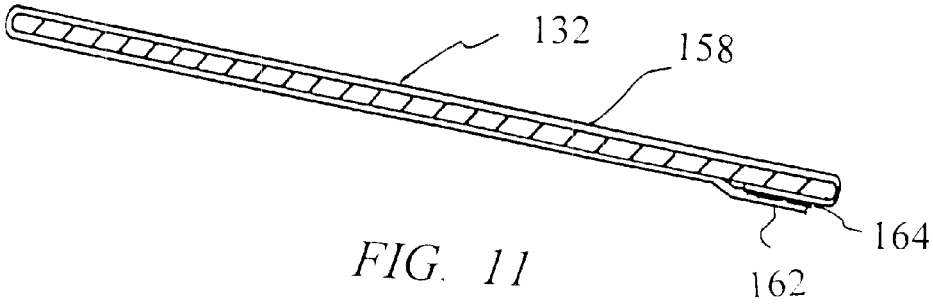

For reasons that will become apparent later, the present invention is adapted to be used with a conventional blow dryer 29 and a heater 30 for shrinking plastic sheets to conform to the components of the model airplane. It should be noted that the blow dryer is used everywhere with the exception of hard to heat areas that need to be superheated. Note FIG. 5. As shown in FIG. 6, the heater includes a base 32 with a generally frusto-conical configuration and an intermediate extent 34 having a cylindrical shape coaxially coupled to a top of the frusto-conical base. An extending arm 36 is provided with an inboard portion coupled to a top of the intermediate extent and extended outwardly therefrom in coaxial relationship therewith. An outboard portion of the extending arm is coupled to a top of the inboard portion and is extended therefrom at an angle of about 120 degrees. A heating disk 38 is fixedly coupled to the outboard portion of the extending arm such that a plane in which the disk resides is positioned in parallel with an axis about which the base is formed.

During use, the heating disk is adapted to generate heat upon the receipt of power. The heater further includes a power cord 40 connected to a bottom of the base for releasably connecting with a power receptacle. The power cord is connected to the heating disk for supplying heat thereto. Such connection is accomplished by way of an unillustrated wire which runs through the base, intermediate extent and extending arm of the heater. As shown in FIG. 1, a box 42 may be provided for storing the foregoing components.

The method associated with the present invention will now be set forth. First, the fuselage and wings of the model airplane are sanded. As an option, the model airplane may be painted various colors. Next the tape is cut such that the pieces of tape each have a length equal to that of at least one of the linear members and the end connectors of a wing. Thereafter, a lower surface of the pieces of tape are applied one at a time along the linear members and end connector.

A scrap portion of one of the plastic sheets is then applied to an upper surface of the pieces of tape for allowing a user to knead out any bubbles beneath the tape necessary to insure integrity of bond. Excess portions of the pieces of the tape which extend beyond the linear members and end connectors are removed with a knife or the like. With its purpose being fulfilled, the scrap portion of the plastic sheet is removed from the upper surface of the pieces of tape.

Figure 4:
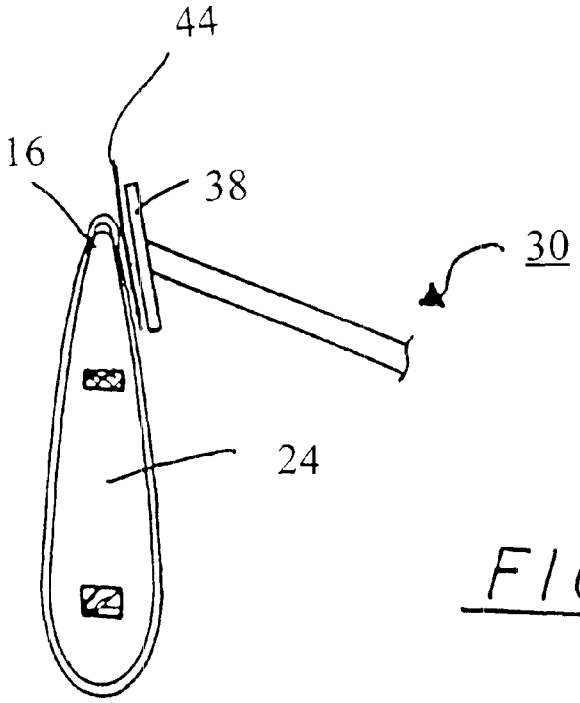
FIG. 4 is a side view of the use of the heater.

Next, a portion of a transparent sheet is folded in half and then cut out with a shape and area slightly larger than that defined by the periphery of the wing. Thereafter, wrinkles are on the entire surface area and must be shrunk to become taut. Once the wrinkles have been identified, the wrinkles of the transparent sheet are approached with the blow dryer until the transparent sheet conforms to the model and becomes taut. In the alternative, the heating disk needs to be used in combination with a thick piece of paper 44, as shown in FIG. 4, to accomplish the same in hard to heat areas, such as the corners and the wing tips. Once the wrinkles begin to disappear, motion is stopped and gentle heating is continued until all of the corners shrink into place.

It should be noted that the principles of the foregoing method may be applied in the covering of the remaining component of the model airplane. A sample of various instructions that may be included with the present invention is as follows:

Instructions

A standard compact hair dryer (1600 watt) will be needed to complete this process.

CAUTION: Heating tool included with this Kit can cause injury (burns) and should be used with caution and common sense. Youngsters should be supervised.

Step 1: Build separate sections of model according to instructions given in model kit. DO NOT JOIN PARTS OF PLANE TOGETHER!!!

Step 2: Paint framework with desired-scheme. NOTE: Points of framework to be joined (glued) should be free of paint. Sand lightly after paint dries. These points MUST also be free of the transparent plastic sheeting (hereafter referred to as "skin")

Step 3: Application of skin. (Landing gear, struts and the like need no skin)

Start with stabilizer and rudder. These parts will be done one side, then the other, for uniformity and ease of small members, but can be done by wrapping.

TO TAPE: Cut double-sided tape to cover longest section of part being done. Align edge of tape to the inside edge of frame with overhang on outside. Using a scrap piece of skin, cover tape and press into place by rubbing firmly with back of model knife or stick pen, as if to drive out bubbles. !This is how tape is attached and must be done every time tape is applied, regardless of width or where applied.

Remove scrap skin from tape and trim excess tape on outside of frame. Also trim excess on inside of frame if needed. Repeat this process until entire outline is taped. Cut piece of skin slightly larger than part on all sides. Stretch gently over entire part and rub into tape with back of model knife or stick pen. (This must be done everywhere skin is applied to tape for proper adhesion.) Trim excess skin on outside of frame. DO NOT HEAT! Tape and apply skin to other side. Once both sides are done, skin is ready to shrink.

TO SHRINK: (Use glare from an existing light to show wrinkles in skin) Turn on hair dryer to full hot. Grasp part by one end and hold hair dryer at least 12 inches above skin. Bring down slowly until skin starts to shrink. Stop. Stay at this height until complete. (CAUTION: Delicate parts can be crushed by skin and must be heated slowly and gently.) Heat other side in the same manner to complete the plane section. To heat hard to reach areas, the heater may be used by placing a thick piece of paper on the skin and the heater placed against the paper for heating the same.

Proceed to next part. Tape and apply skin in same manner.

WINGS: Will be wrapped. NOTE: Before covering (while building), observe the points where the struts will connect wings (as in biplane). These points must be boxed in by scrap wood from the kit. Any other surfaces where it will be necessary to attach struts or other outer body accessories (antenna, fuel tank and the like) must be taped before skin is applied, and cut out afterward so that the skin will remain intact and a wood to wood connection can be made when these pieces are attached.

To apply skin to wings: Work on waxed paper. Tape boxed in strut and outer body accessory points first. Trim overhang. Trim out inner hole of strut points after wing is skinned. (If a biplane, start with top wing.) Work from underside. Tape outline of wing. Cut piece of skin, lay flat and smooth. Lay taped side of wing on skin with trailing edge of wing approx 2 inches from edge of skin so that overhang exists. Turnover and rub into place. Trim overhang of trailing edge around wing tips to leading edge. Stop.

Retape and trim trailing edge only. Wrap skin around each wing tip one at a time. Apply first piece of tape and trim. Fold skin over tape and rub into place. Cut skin where tape stops from outer edge of tip to inside. Apply next piece of tape where first one stopped, overlapping slightly. Trim. Fold skin and cut where tape stops, same as first. Continue in this manner until wing tip is closed, trimming overhang on inside edge of skin as you go skin will form corners around wing tip.

Close other side. Heat to shrink most of wing, not tips. DO NOT TRY TO HEAT TIPS WITH HAIR DRYER! Preheat the small heating iron included in kit of approx. 5 minutes. Cover corners of wings tip with a thick piece of paper. Touch tool to paper for 1 to 3 seconds at a time to shrink corners to the shape of the wing tip. DO NOT OVERHEAT. Then heat wing with hair dryer again to make sure shrinkage is complete.

Next wing: When taping wing that will directly connect to underside of fuselage (center rib will be glued to fuselage and MUST remain free of skin) start as before; outlining bottom of wing and taping strut points first. Tape top of ribs on both sides of center rib, wrapping around and overlapping tape on underside of wing. DO NOT TRIM OVERHANG! (This wing will most likely have dihedral added.) Cut skin as before and lay flat. Set center of wing on skin first. Press on side of wing down to skin, then the other side. Turn over and rub into place. Retape trailing edge as before; wrap skin around wing and rub into place.

NOTE: If leading edge and trailing edge are not parallel but tapered, do not pull skin tight to either edge. Simply fold skin in half leaving folded overhang along leading edge. Cut skin along leading edge from point where it will be folded over, out to tip. Retape leading edge. Fold skin and rub into place. Repeat as needed, as in closing wing tips. Close wing tips. Heat to shrink, same as first wing. After wing is finished, cut out skin on top center of wing; start at overhang of tape and move to center rib. Skin around rest of wing will remain intact. (If skin becomes damaged, simply peel it off down to first piece of tape and reskin.)

FUSELAGE: Attach engine cowling and canopy (if included) first. Start to tape at cowling. *Position ½ width of tape over cowling, wrap around, keeping smooth. *Position ½ width of tape around cockpit (or canopy) and head rest, overlapping tape to form a closed pattern around opening of fuselage.

Tape around wing opening in same manner. Tape around tail section in same manner. Tape bottom of fuselage along center spar from wing opening to tail end of fuselage and from opening to cowl using full width of tape. Do not trim overhang. Tape center spar on top of fuselage from cockpit cowl. *Trim tape that overhangs wood fuselage.

Cut piece of skin large enough to wrap around fuselage with overhang on all sides. Start with center of skin over top back center of fuselage. Pull down over side and press onto tape at wing opening. Press onto tape around cockpit and head rest. Press onto tail section.

Take on edge of skin and press onto bottom back seam. Trim overhang the length of seam only. Working from this side of fuselage, smooth out skin up to cowl. Trim wing opening. Set front bottom seam. Trim. (Skin can be pealed from tape to reposition if needed) Trim overhang of skin around cockpit on this side only and ½ way over head rest. Press skin onto top front seam; trim. Pull skin over other side and press onto all taped areas; trim. Retape top front seam, press skin and trim. Retape bottom seams, press skin, trim. (A slightly loose wrap is acceptable.) Heat to Shrink.

Assemble respective parts. Build plane.

As can be seen in the embodiment of FIGS. 7 through 11, a model airplane 100 with a construction for reduced weight and increased strength includes a main body component 102 of an elongated configuration.

The main body component has a front end 104, a rear end 106, a top 108, a bottom 110, a left side 112, and a right side 114.

A wing component 118 is provided. The wing component includes a left wing 120 and a right wing 122. Each wing has an interior edge 124 coupled with respect to the main body component and extends outwardly from each side.

A horizontal stabilizer component 128 is next provided. The horizontal stabilizer component includes a left portion 130 and a right portion 132. Each portion of the horizontal stabilizer component has an exterior edge 134 and an interior edge 136 coupled with respect to, and adjacent to the rear of, the main body portion.

Next provided is a vertical stabilizer component 140. The vertical stabilizer component has an upper edge 142 and a lower edge 144 coupled to, and adjacent to the rear end of, the main body component.

Each of the components is fabricated of a shell of lightweight balsa wood 148 with spaces there between. A sheet of lightweight plastic material 152 covers each of the components. The material is wrapped around each of the components with an individual sheet for each component. The individual sheets include a main body component sheet 154, a wing component sheet 156, a horizontal stabilizer sheet 158, and a vertical stabilizer sheet 160. The sheet for each component is unitary and has but a single seam 162 with a double-faced adhesive 164 closing the seam along its length.

The plastic material 152 is transparent and lightweight and has a thickness of between about 0.65 and 0.85 mils, preferably about 0.75 mils. The plastic material also has the ability when heated to contract to between about 20 and 30 percent, preferably 25 percent of its original size. Such material is commercially available and sold as Crystal Clear Stretch film by Thermwell Products Co., Inc. of Paterson, N.J., under the tradename Frost King. Previously a much thicker film material was used for these plane covering purposes, a material with a thickness of between about 3 and 4 mils which shrunk between about 10 and 20 percent. Such material required cutting of the sheet material into plural sections for each component of the airplane, a time consuming task, and which did not afford the added strength of the present invention. In this manner strength enhancing capability is produced to the frame.

Lastly, a motion imparting system 166 is provided. The motion imparting system includes a propeller 168 for rotating at the front end of the main body portion. The motion imparting system also includes a rubber band 170 coupling the propeller to an intermediate portion of the housing. In this manner rotation of the propeller is effected. Note is further taken that the transparent sheet material allows for viewing the wooden structure 174 there beneath for an improved visual effect.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A thickness of between 0.65 and 0.85 mils, and having the ability when heated to contract to between 20 and 30 percent of its original size.

* * * * *

UNITED STATES PATENT AND TRADEMARK OFFICE

CERTIFICATE OF CORRECTION

PATENT NO. : 6,428,380 B1 
DATED : August 6, 2002
INVENTOR(S) : Michael B. Murphy It is certified that error appears in the above-identified patent and that said Letters Patent is hereby corrected as shown below:

Column 8,
Line 37, delete "A" and insert -- a --; and
before "a thickness of between 0.65 and 0.85 mils…" insert
-- A new and improved model airplane with a construction for reduced weight and increased strength comprising, in combination:

a main body component of an elongated configuration having a front end, a rear end, a top, a bottom, a left side, and a right side;

a wing component including a left wing and a right wing, each wing having an interior edge coupled with respect to the main body component and extending outwardly from each side;

a horizontal stabilizer component including a left portion and a right portion, each with an exterior edge and an interior edge with each interior edge coupled with respect to the main body component adjacent to the rear end thereof;

a vertical stabilizer component having an upper edge and a lower edge coupled to the main body component adjacent to the rear end thereof;

each of the components fabricated of a shell of lightweight balsa wood with spaces therebetween;

a plurality of individual sheets of lightweight plastic material with each individual sheet covering only one of the components, the material being wrapped around each of the components with an individual sheet for each component, the sheets including a main body component sheet, a wing component sheet, a horizontal stabilizer sheet, and a vertical stabilizer sheet, the sheet for each component being unitary and having but a single seam with a double-faced adhesive closing the seam along its length, the plastic material being transparent and lightweight with --.

UNITED STATES PATENT AND TRADEMARK OFFICE

CERTIFICATE OF CORRECTION

PATENT NO. : 6,428,380 B1
DATED : August 6, 2002
INVENTOR(S) : Michael B. Murphy It is certified that error appears in the above-identified patent and that said Letters Patent is hereby corrected as shown below:

Column 8 cont.,
Line 38, after "...between 20 and 30 percent of its original size" insert
-- and produce a strength enhancing capability to the frame; and A motion imparting system including a propeller for rotating at the front end of the main body portion and a rubber band coupling the propeller to an intermediate portion of the housing to rotate the propeller. --

Signed and Sealed this

Twenty-second Day of October, 2002

*Attest:*

*Attesting Officer*

JAMES E. ROGAN
*Director of the United States Patent and Trademark Office*